US006332848B1

(12) United States Patent
Long et al.

(10) Patent No.: US 6,332,848 B1
(45) Date of Patent: Dec. 25, 2001

(54) METAL WOOD GOLF CLUB HEAD

(75) Inventors: D. Clayton Long, Carlsbad; Thomas L. Crow, La Jolla, both of CA (US)

(73) Assignee: Cobra Golf Incorporated, Carlsbad, CA (US)

( * ) Notice: Subject to any disclaimer, the term of this patent is extended or adjusted under 35 U.S.C. 154(b) by 0 days.

(21) Appl. No.: 09/493,927

(22) Filed: Jan. 28, 2000

Related U.S. Application Data

(60) Provisional application No. 60/117,538, filed on Jan. 28, 1999.

(51) Int. Cl.[7] ..... A63B 53/04

(52) U.S. Cl. ..... 473/328; 473/345; 473/349

(58) Field of Search ..... 473/324, 334, 473/335, 336, 337, 338, 339, 345, 346, 347, 348, 349, 256, 328; D21/733, 752

(56) References Cited

U.S. PATENT DOCUMENTS

| | | | |
|---|---|---|---|
| D. 402,726 | 12/1998 | McCabe et al. | D21/753 |
| 632,885 | 9/1899 | Sweny . | |
| 645,944 | 3/1900 | Dalgleish . | |
| 656,099 | 8/1900 | Dunn . | |
| 690,996 | 1/1902 | Ransom . | |
| 727,819 | 5/1903 | Mattern . | |
| 734,065 | 7/1903 | Heeren . | |
| 739,458 | 9/1903 | Travis . | |

(List continued on next page.)

FOREIGN PATENT DOCUMENTS

| | | |
|---|---|---|
| 238646 | 5/1962 | (AU) . |
| 844455 | 6/1970 | (CA) . |
| 160030 | 3/1921 | (GB) . |
| 413024 | 7/1934 | (GB) . |
| 2 225 725 A | 6/1990 | (GB) . |
| 2-116389 | 5/1990 | (JP) . |
| 5-103847 | 4/1993 | (JP) . |
| 6-091020 | 4/1994 | (JP) . |
| 7-185049 | 7/1995 | (JP) . |
| 8-322970 | 12/1996 | (JP) . |
| 9-28841 | 2/1997 | (JP) . |
| 10-94623 | 4/1998 | (JP) . |
| 10-99474 | 4/1998 | (JP) . |
| 10-225538 | 8/1998 | (JP) . |
| 11-178955 | 7/1999 | (JP) . |
| W/O 94/06519 | 3/1994 | (WO) . |

OTHER PUBLICATIONS

Leyland Sports, Inc., 75–322,917, Jul. 11, 1997 (Pending Trademark).

Pro Kennex, Inc., 2,029,383, Feb. 28, 1995 (Registered Trademark).

Callaway Golf Company, 1,922,181, Jan. 1, 1989 (Registered Trademark).

(List continued on next page.)

*Primary Examiner*—Sebastiano Passaniti
(74) *Attorney, Agent, or Firm*—Pennie & Edmonds LLP

(57) ABSTRACT

Disclosed is a metal wood club head with a body having a crown a sole, a skirt and a strike face. The sole has a first cavity located rearwards and towards the heel of the club head and a second cavity located rearwards towards the toe of the club head and approximately opposite of the first cavity. The two cavities define a relatively flat ridge or land area extending from the front of the sole rearwards which forms a beam-like stiffening structure. A backweight may be attached to the body portion to redistribute mass more rearwardly in the club head and directly behind the stiffening ridge. The redistribution of the mass rearwards increases the dynamic loft and moment of inertia of the club head and its position behind the stiffening ridge enhances energy transfer upon striking of a ball. The disclosed club head is thus provided with an increased moment of inertia to resist rotation and enhanced striking efficiency without an increase in club volume.

17 Claims, 3 Drawing Sheets

U.S. PATENT DOCUMENTS

| | | |
|---|---|---|
| 942,353 | 12/1909 | Rigden . |
| 1,091,231 | 3/1914 | Millar . |
| 1,096,359 | 5/1914 | Dwight . |
| 1,167,106 | 1/1916 | Palmer . |
| 1,203,250 | 10/1916 | Ogilvie . |
| 1,283,568 | 11/1918 | Sampson . |
| 1,289,192 | 12/1918 | Klin . |
| 1,299,014 | 4/1919 | O'Hara . |
| 1,319,233 | 10/1919 | Mattern . |
| 1,322,182 | 11/1919 | Duncan . |
| 1,336,671 | 4/1920 | Backus . |
| 1,349,806 | 8/1920 | Booth . |
| 1,361,258 | 12/1920 | Horton . |
| 1,444,409 | 2/1923 | Willmott . |
| 1,449,559 | 3/1923 | Relle . |
| 1,452,695 | 4/1923 | Mattern . |
| 1,452,845 | 4/1923 | Pryde . |
| 1,455,256 | 5/1923 | Kraeuter . |
| 1,459,810 | 6/1923 | Wills . |
| 1,483,614 | 2/1924 | Reach . |
| 1,497,578 | 6/1924 | Mothersele . |
| 1,502,328 | 7/1924 | Beat . |
| 1,504,326 | 8/1924 | Cullinan . |
| 1,509,429 | 9/1924 | Hillerich . |
| 1,526,438 | 2/1925 | Scott . |
| 1,528,017 | 3/1925 | Gammeter . |
| 1,549,993 | 8/1925 | Klin . |
| 1,567,248 | 12/1925 | Dahlman . |
| 1,567,323 | 12/1925 | Jordan . |
| 1,588,617 | 6/1926 | Rose . |
| 1,605,551 | 11/1926 | Mattern . |
| 1,611,110 | 12/1926 | East . |
| 1,619,566 | 3/1927 | Crankshaw . |
| 1,659,273 | 2/1928 | Link . |
| 1,659,274 | 2/1928 | Link . |
| 1,669,482 | 5/1928 | Miller . |
| 1,672,618 | 6/1928 | Link . |
| 1,680,881 | 8/1928 | Heeter et al. . |
| 1,780,625 | 11/1930 | Mattern . |
| 1,840,924 | 1/1932 | Tucker . |
| 1,868,286 | 7/1932 | Grieve . |
| 1,910,055 | 5/1933 | Reach . |
| 1,916,792 | 7/1933 | Hadden . |
| 1,942,434 | 1/1934 | Link . |
| 1,946,208 | 2/1934 | Hampton . |
| 1,968,092 | 7/1934 | Oldham . |
| 2,041,676 | 5/1936 | Gallagher . |
| 2,201,638 | 5/1940 | Theibault, Sr. . |
| 3,064,980 | 11/1962 | Steiner . |
| 3,068,011 | 12/1962 | Sano . |
| 3,212,783 | 10/1965 | Bradley et al. . |
| 3,220,733 | 11/1965 | Saleeby . |
| 3,759,517 | 9/1973 | Mills . |
| 3,761,095 | 9/1973 | Thompson . |
| 3,815,921 | 6/1974 | Turner . |
| 3,819,181 | 6/1974 | Mills . |
| 3,941,390 | 3/1976 | Hussey . |
| 4,076,254 | 2/1978 | Nygren . |
| 4,214,754 | 7/1980 | Zebelean . |
| 4,313,607 | 2/1982 | Thompson . |
| 4,325,550 | 4/1982 | Thompson et al. . |
| 4,332,388 | 6/1982 | Crow . |
| 4,432,549 | 2/1984 | Zebelean . |
| 4,451,042 | 5/1984 | Hayashi et al. . |
| 4,465,221 | 8/1984 | Schmidt . |
| 4,545,580 | 10/1985 | Tomita et al. . |
| 4,756,534 | 7/1988 | Thompson . |
| 4,811,950 | 3/1989 | Kobayashi . |
| 4,824,110 | 4/1989 | Kobayashi . |
| 4,852,880 | 8/1989 | Kobayashi . |
| 4,872,685 | 10/1989 | Sun . |
| 5,028,049 | 7/1991 | McKeighen . |
| 5,042,806 | 8/1991 | Helmstetter . |
| 5,056,705 | 10/1991 | Wakita et al. . |
| 5,067,715 | 11/1991 | Schmidt et al. . |
| 5,090,702 | 2/1992 | Viste . |
| 5,092,599 | 3/1992 | Okumoto et al. . |
| 5,100,144 | 3/1992 | Okumoto et al. . |
| 5,163,682 | 11/1992 | Schmidt et al. . |
| 5,171,621 | 12/1992 | Desbiolles et al. . |
| 5,180,166 | 1/1993 | Schmidt et al. . |
| 5,193,811 | 3/1993 | Okumoto et al. . |
| 5,228,615 | 7/1993 | Iijima et al. . |
| 5,240,252 | 8/1993 | Schmidt et al. . |
| 5,257,786 | 11/1993 | Gorman . |
| 5,272,802 | 12/1993 | Stites, III . |
| 5,282,624 | 2/1994 | Viste . |
| 5,288,079 | 2/1994 | Katayama . |
| 5,294,037 | 3/1994 | Schmidt . |
| 5,299,807 | 4/1994 | Hutin . |
| 5,301,945 | 4/1994 | Schmidt et al. . |
| 5,306,450 | 4/1994 | Okumoto et al. . |
| 5,310,185 | 5/1994 | Viollaz et al. . |
| 5,310,186 | 5/1994 | Karsten . |
| 5,314,185 | 5/1994 | Gorman . |
| 5,316,298 | 5/1994 | Hutin et al. . |
| 5,318,300 | 6/1994 | Schmidt et al. . |
| 5,354,055 | 10/1994 | MacKeil . |
| 5,377,986 | 1/1995 | Viollaz et al. . |
| 5,397,127 | 3/1995 | Kawada et al. . |
| 5,398,935 | 3/1995 | Katayama . |
| 5,405,137 | 4/1995 | Vincent et al. . |
| 5,415,405 | 5/1995 | Vincent . |
| 5,421,577 | 6/1995 | Kobayashi . |
| 5,425,538 | 6/1995 | Vincent et al. . |
| 5,429,358 | 7/1995 | Rigal et al. . |
| 5,441,263 | 8/1995 | Gorman . |
| 5,447,309 | 9/1995 | Vincent . |
| 5,451,056 | 9/1995 | Manning . |
| 5,456,469 | 10/1995 | MacDougall . |
| 5,460,376 | 10/1995 | Schmidt et al. . |
| 5,465,970 | 11/1995 | Adams et al. . |
| 5,467,988 | 11/1995 | Henwood . |
| 5,470,068 | 11/1995 | Schmidt et al. . |
| 5,470,069 | 11/1995 | Schmidt et al. . |
| 5,474,296 | 12/1995 | Schmidt et al. . |
| 5,480,152 | 1/1996 | Schmidt et al. . |
| 5,482,279 | 1/1996 | Antonious . |
| 5,482,280 | 1/1996 | Yamawaki . |
| 5,484,155 | 1/1996 | Yamawaki et al. . |
| 5,485,998 | 1/1996 | Kobayashi . |
| 5,497,995 | 3/1996 | Swisshelm . |
| 5,516,106 | 5/1996 | Henwood . |
| 5,516,107 | 5/1996 | Okumoto et al. . |
| 5,518,243 | 5/1996 | Redman . |
| 5,547,188 | 8/1996 | Dumontier et al. . |
| 5,547,427 | 8/1996 | Rigal et al. . |
| 5,570,886 | 11/1996 | Rigal et al. . |
| 5,573,467 * | 11/1996 | Chou . |
| 5,573,469 | 11/1996 | Dekura . |
| 5,577,550 | 11/1996 | Schmidt . |
| 5,582,553 | 12/1996 | Ashcraft et al. . |
| 5,611,741 | 3/1997 | Schmidt . |
| 5,643,104 | 7/1997 | Antonious . |
| 5,643,107 | 7/1997 | Gorman . |
| 5,645,495 | 7/1997 | Saso . |
| 5,669,827 | 9/1997 | Nagamoto . |
| 5,669,828 | 9/1997 | Schmidt . |
| 5,697,853 | 12/1997 | Schmidt et al. . |
| 5,709,617 | 1/1998 | Nishimura et al. . |
| 5,720,674 | 2/1998 | Galy . |

| | | | | |
|---|---|---|---|---|
| 5,735,754 | | 4/1998 | Antonious . | |
| 5,755,624 | | 5/1998 | Helmstetter . | |
| 5,762,567 | | 6/1998 | Antonious . | |
| 5,779,565 | | 7/1998 | Adams . | |
| 5,785,605 | | 7/1998 | Helmstetter . | |
| 5,785,609 | | 7/1998 | Sheets et al. . | |
| 5,797,807 | | 8/1998 | Moore . | |
| 5,851,159 | | 12/1998 | Burrows . | |
| 5,851,160 | | 12/1998 | Rugge et al. . | |
| 5,989,134 | * | 11/1999 | Antonious . | |
| 6,027,416 | | 2/2000 | Schmidt et al. | 473/345 |

OTHER PUBLICATIONS

Callaway Golf Company, 1,918,108, Jan. 1, 1991 (Registered Trademark).

Callaway Golf Company, 1,947,849, Jan. 1992 (Registered Trademark).

"Wilson Golf History Catalogs", Edited by Jim Kaplan, Vintage Golf, Glencoe, IL., 1974, Cover page, pp. 5, 1931; 4, 1933; 6, 1938; 9, 1938; 2, 1941; 3, 1941; 3, 1948; 6, 1948; 1, 1954; 2, 1956; 3, 1957; 3, 1973; 5, 1973; 5, 1974; 4, 1974; 2–5, 1975; 1–2, 1976; 6, 1977; 1, 1978.

Golf Week, Jan. 16, 1999, "Callaway's Latest: Hawk Eye Metalwoods", p. 3.

Golf World, Jan. 15, 1999, "Callaway Introduces New Titanium Woods", p. 4.

"Comprehensive Catalogue of Golf Related Products—1984 Edition"; pp. 264, 280, 350, 393, 415, 450, 474, 501, 503, 505, 563, 595, and 596; published Mar. 1, 1984 in Chiyo-da–du, Tokyo.

Golf Equipment Universal Catalogue, Feb. 1, 1998, ENA 1998 New Model, p. 358.

Golf World, Apr. 4, 1972, "Arrowhead Custom Golf, Inc." Ad, p. 30.

* cited by examiner

METAL WOOD GOLF CLUB HEAD

This application claims benefit of Prov. No. 60/117,538 filed Jan. 28, 1999.

BACKGROUND

The present invention relates generally to the field of golf clubs and more particularly to the manufacture of metal "wood" club heads.

It is well known that accuracy and distance are the two primary concerns when making golf shots with a "wood" type club (hereinafter referred to as "wood" or "woods"), such as a driver or a fairway wood. Accuracy and distance are inter-related in the sense that an accurate shot traveling a shorter distance may still be much closer to the hole than an inaccurate shot traveling a much longer distance. Nevertheless, for the purpose of this discussion distance and accuracy will be treated as distinct.

Maximizing distance requires, among other things, efficient transfer of energy from the club head to the ball at impact. One factor affecting the energy transfer is the material used to make the club head. When making a wood club head from wood, designers select a hard wood, traditionally either persimmon or laminated maple, and more recently have provided metallic strike face inserts to increase energy transfer. Recent improved manufacturing techniques have allowed construction of hollow woods made entirely of metal, particularly of titanium and stainless steel, providing marked improvements over their wooden counterparts. Even though improved, hollow metal woods can experience a certain amount of uncontrolled deformation away from the strike face, especially in the larger oversize heads, which can contribute to degrading the club head/ball energy transfer.

Another factor affecting distance is the "loft" of the club, which determines the trajectory of the ball after impact. There are several factors that determine the "loft" or trajectory of a ball upon impact. The first is the loft angle. It is readily apparent that a larger loft angle will result in a higher trajectory. The location the club head's center of mass relative to that of the ball, measured vertically up from the sole plate also affects the trajectory. All else being equal, a club head with a lower center of mass will result in a higher trajectory. If the center of mass of the club head is above that of the ball, it will produce a much lower trajectory and the ball will carry much less distance. Another factor affecting trajectory is the dynamic loft which, among other things, is determined by shaft flexibility and location the club head's center of mass measured horizontally from the club face. The average player has difficulty obtaining the desired ball trajectory, and thus difficulty in achieving the desired distance, when using a driver or other wood club because these clubs have traditionally had a relatively small loft angle high and forward center of mass.

A factor affecting accuracy is the resistance of the club head to rotate about a vertical axis passing through the club head's center of mass, otherwise known as the moment of inertia. For example, the dynamic forces generated through the swing result in torque being applied to the shaft which can result in excessive opening of the club face. Also, if at impact the ball strikes on line with the center of mass there will be little or no twisting about this point. However, if as in many cases, the ball strikes off the center of mass towards the heel or toe of the club head, the club head will tend to rotate about the center of mass imparting side spin to the ball causing it to stray from its intended path. Light weight, high strength materials, such as titanium, have enabled club manufacturers to increase the size of the club head, thereby increasing the moment of inertia of the club head and to some extent addressing these difficulties. Oversized club heads have unquestionably done very well in the market place.

Different designs have been attempted to address various aspects of the difficulties described above. For example, U.S. Pat. No. 5,720,674 discloses a golf club head with a high density peripheral strip around the club head behind the strike face. It is asserted in the disclosure that the arrangement combines "the effect of stabilization during rotation and dynamic loft." In another design, disclosed in U.S. Pat. No. 5,785,605, an oversized metal wood head is disclosed in which recesses are positioned in the bottom wall in order to add "bottom wall strength and stiffness." Another club which is available on the market, the "Crane Magic Wand", attempts to address some of the previously discussed deficiencies by positioning a weight on the back of a relatively large club head.

In spite of the various attempts, the prior art has not achieved a head design which successfully combines the various aspects of club performance. There thus remains a need in the art for a hollow metal wood club with improved moment of inertia, energy transfer and dynamic loft achieved without otherwise significantly altering overall mass or excessively increasing the volume of the club head.

SUMMARY OF THE INVENTION

An embodiment of the present invention which addresses the need in the art comprises a metal wood club head with a body having a crown a sole, a skirt and a strike face. The sole has a first cavity located rearwards and towards the heel of the club head and a second cavity located rearwards towards the toe of the club head and approximately opposite of the first cavity. The two cavities define a relatively flat ridge or land area extending from the front of the sole rearwards. The sole within the two cavities can be made relatively thin allowing removal of mass from the sole. A backweight is attached to the rear most position of the body portion. The backweight facilitates redistribution of mass removed from other areas of the head to the rear-most position. The redistribution of the mass rearwards increases the dynamic loft and moment of inertia of the club head. A concave depression in the sole may be provided directly rearwards of the ridge, as a rearward boundary to the land area which in combination with the two cavities define a beam-like configuration that stiffens the sole along an axis perpendicular to the strike face. Preferably the backweight is positioned substantially in line with the beam-like ridge to facilitate energy transfer to the strike face. Additionally, two approximately oval shaped dimples may be provided on the crown, located rearwards on the crown and opposite each other, thus defining an approximately hour glass shaped spine extending forward from the backweight to just past approximately midway of the top surface. The two dimples and the approximately hour glass shaped spine also help to stiffen the crown along an axis perpendicular to the strike face.

DETAILED DESCRIPTION OF THE PREFERRED EMBODIMENTS

An exemplary embodiment of a metal wood type club head 10 in accordance with the principles of the present invention is shown in FIGS. 1–5. Club head 10 is preferably made from titanium or stainless steel, but other metals or alloys having similar strength to weight characteristics may be used. Club head 10 generally includes a body portion with a backweight 24 attached thereto. As is known in the art, the body portion may be cast in two portions, crown 12 and sole plate 14, which are welded together.

Figure 1:
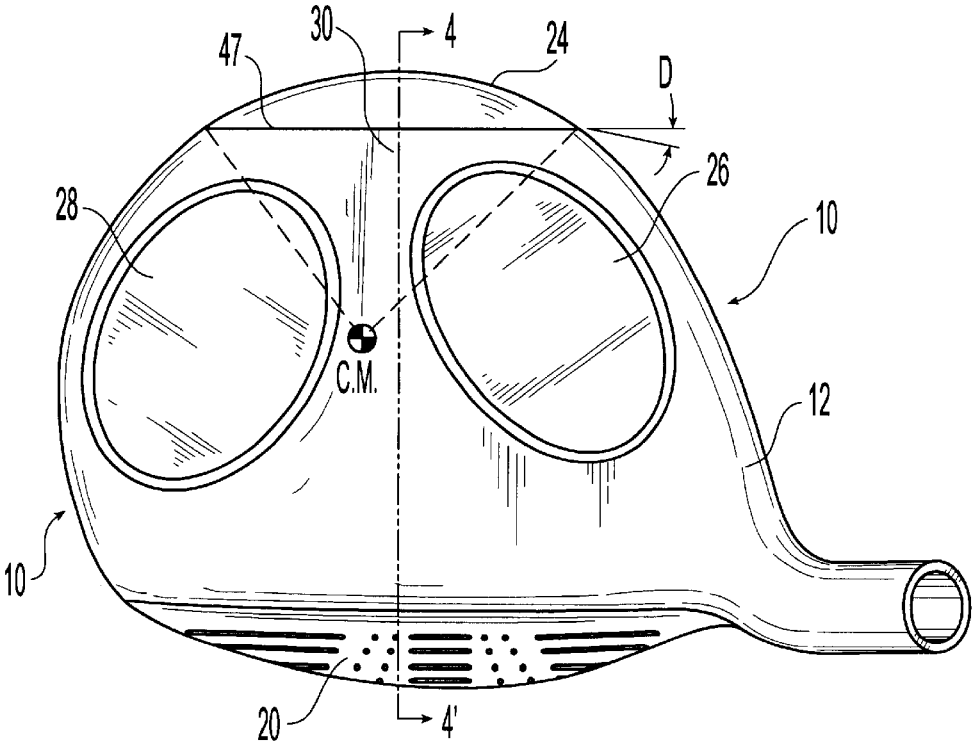
FIG. 1 is a top view of a club head according to an embodiment of the present invention.
Figure 2:
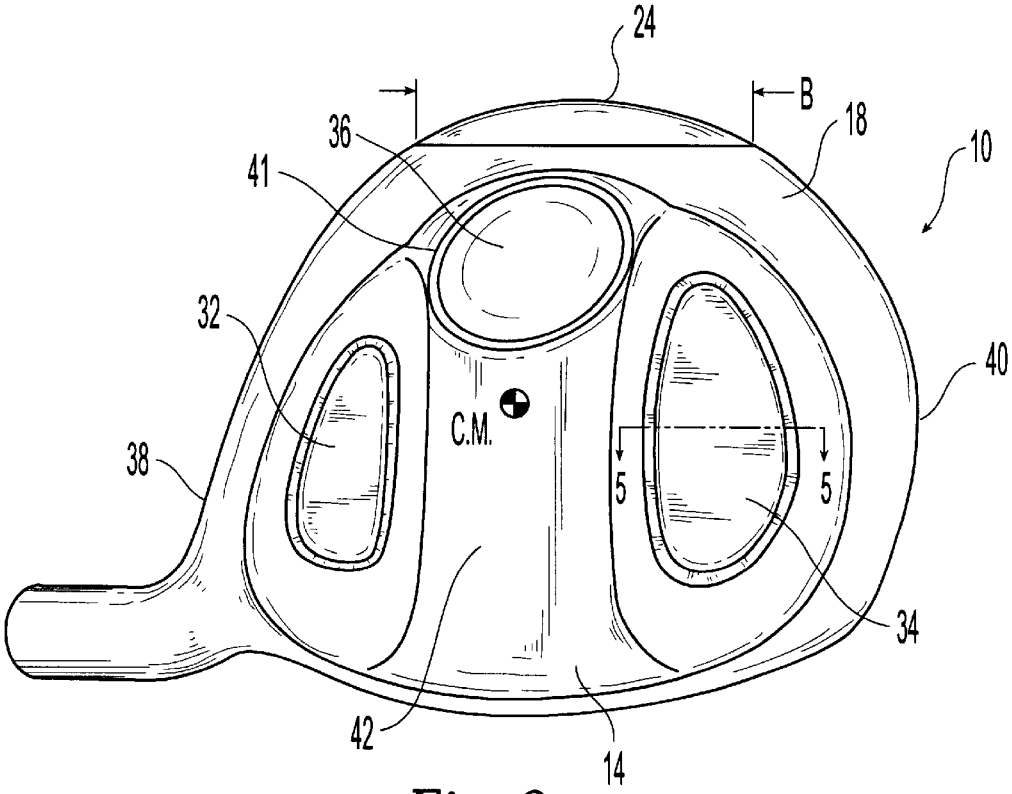
FIG. 2 is a bottom view of the club head depicted in FIG. 1.
Figure 3:
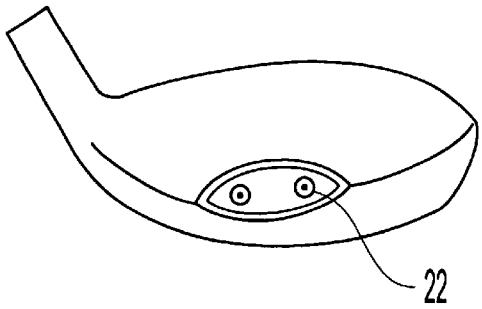
FIG. 3 is a back view of the club head depicted in FIG. 1, without the backweight attached.
Figure 4:
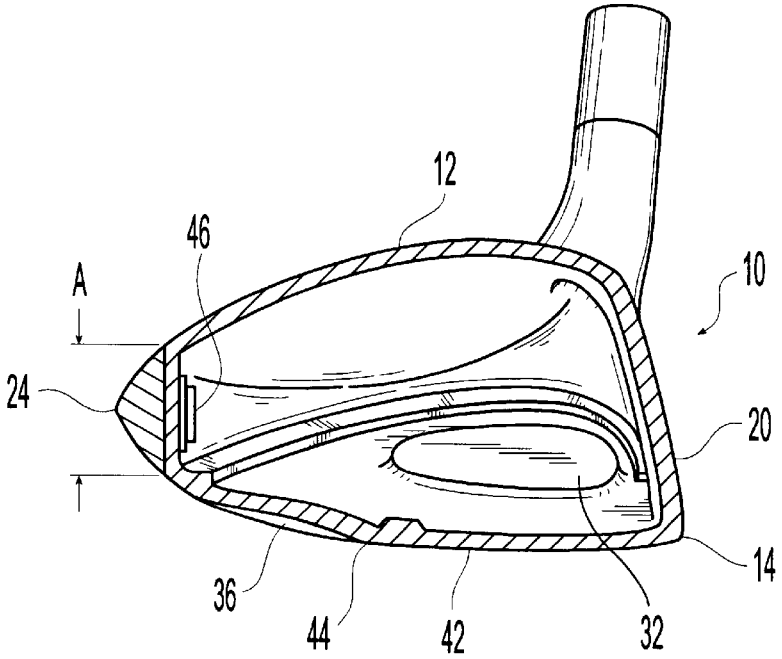
FIG. 4 is a cross sectional view along line 4—4 of the club head depicted in FIG. 1.

Referring to FIGS. 1 and 2, head 10 comprises crown 12, skirt 18, strike face 20 and back portion 22 (FIG. 3), to which is attached backweight 24. Dimples 26 and 28, located rearward on crown 12, define an approximately hour glass shaped spine 30. Spine 30 extends from approximately backweight 24 between the inner edges of dimples 26 and 28 to just past the mid-way point between backweight 24 and strike face 20. Dimples 26 and 28 provide a contoured configuration that increases the stiffness of crown 12 along an axis perpendicular to strike face 20.

Sole plate 14 has first cavity 32, second cavity 34 and concave depression 36. First cavity 32 is located towards heel 38, and second cavity 34 is located towards toe 40 and approximately opposite from first cavity 32. Depression 36 is located rearward of cavities 32 and 34 and approximately in the center of sole plate 14. A relatively flat ridge 42 extends from the front of depression 36 between cavities 32 and 34 to the lower edge of strike face 20. Ridge 42 forms a land area on sole plate 14. The leading edge 44 of depression 36 preferably lies at least about 0.1 inches rearward of the center of mass (C.M.) to ensure that club head 10 will lay properly and not fall back when sitting at rest. It is also preferred, but not required, that the distance from the strike face along ridge 42 to edge 44 be not less than about 1.6 inches.

Figure 5:
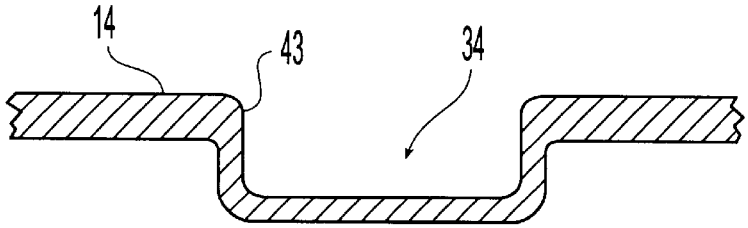
FIG. 5 is a cross sectioned view along line 5—5 as shown in FIG. 2.

The structural configuration of cavities 32 and 34 is illustrated in FIG. 5. The structural configuration of depression 36 can be seen in FIG. 4. The two different types of recesses have two different designs. Cavities 32 and 34 have distinct side walls 43, whereas depression 36 is preferably dish-shaped, without distinct sidewalls. Depression 36, cavity 32, cavity 34 and ridge 42 together define a beam-like configuration that increases the stiffness of sole plate 14 along an axis perpendicular to strike face 20. The distinct sidewalls of cavities 32 and 34 help to further increase the stiffness by adding web area to the beam-like configuration. The increased stiffness of crown 12 as described above, in combination with the increased stiffness of sole plate 14, results in a enhanced energy transfer for a club head made in accordance with the present invention by reducing undesirable deformation and transferring more energy to the strike face.

In accordance with the invention, typical club head mass may be between about 188 to 212 grams. More preferably the mass will be within the range of about 195 to 205 grams. Mass may be redistributed to the back of club head 10 by attaching backweight 24, preferably but not necessarily, made from a material having a relatively higher density, thus shifting the center of mass rearwards. In a preferred embodiment, the center of mass is located at least about 0.95 inches behind the shaft center line at the entry into the club head. Mass may be redistributed rearward by an overall thinning of the club head wall. In an exemplary embodiment, crown 12 and sole plate 14 have a finished thickness of less than 0.065 inches, preferably about 0.050+0.005/−0.000 inches. Skirt 18 has a nominal thickness of less than 0.065 inches, preferably about 0.050 inches. However, the finished thickness of the skirt, particularly in the back portion, may be varied through machining to compensate for mass variation in the cast heads. The bottom walls within first and second cavities 32 and 34 also can be cast relatively thin because they will not contact the ground and are protected from the finish machining by side walls 43. This permits the removal and thereby the redistribution of additional mass from sole plate 14 to the back weight if desired. As a result, moving the center of mass rearwards tends to increase the moment of inertia without modifying either the overall mass or volume of club head 10. Preferably the volume of the club head will be less than 250 cc and more preferably about 240 cc with a moment of inertia of at least about 3200 $g \cdot cm^2$. Additionally, moving the center of mass rearwardly increases dynamic loft of club head 10 as previously discussed.

Preferably backweight 24 is at least about 18 grams with a dimension A (FIG. 4) of about 0.75 inches and a dimension B (FIG. 3) of about 1.9 inches and is made from an aluminum-brass alloy (82% Cu, 11% Al, 4% Fe and 2.5% Ni). Also, preferably the backweight comprises about 7 to 15 percent of the total club head mass and more preferably about 8.8 to 9.1 percent of the total mass. Moreover, the advantages achieved by backweighting will be minimized if the mass is not concentrated sufficiently at the rear. Thus, according to the present invention, it is preferred that backweight 24 be contained within an included angle C (FIG. 1) of not greater than about 110 degrees measured at the center of mass, centered around a line perpendicular to the strike face. In a more preferred embodiment angle C is less than about 80 degrees. In a further aspect of the invention, the front face 47 of backweight 24 is tilted towards the heel by an angle D (FIG. 1) which is measured from a line tangent to the face at 0 degrees face angle. Preferably D is about 3.5 to 6 degrees and more preferably about 4.75 degrees. Preferably the backweight is also slightly more towards the heel of the club.

Figure 6:
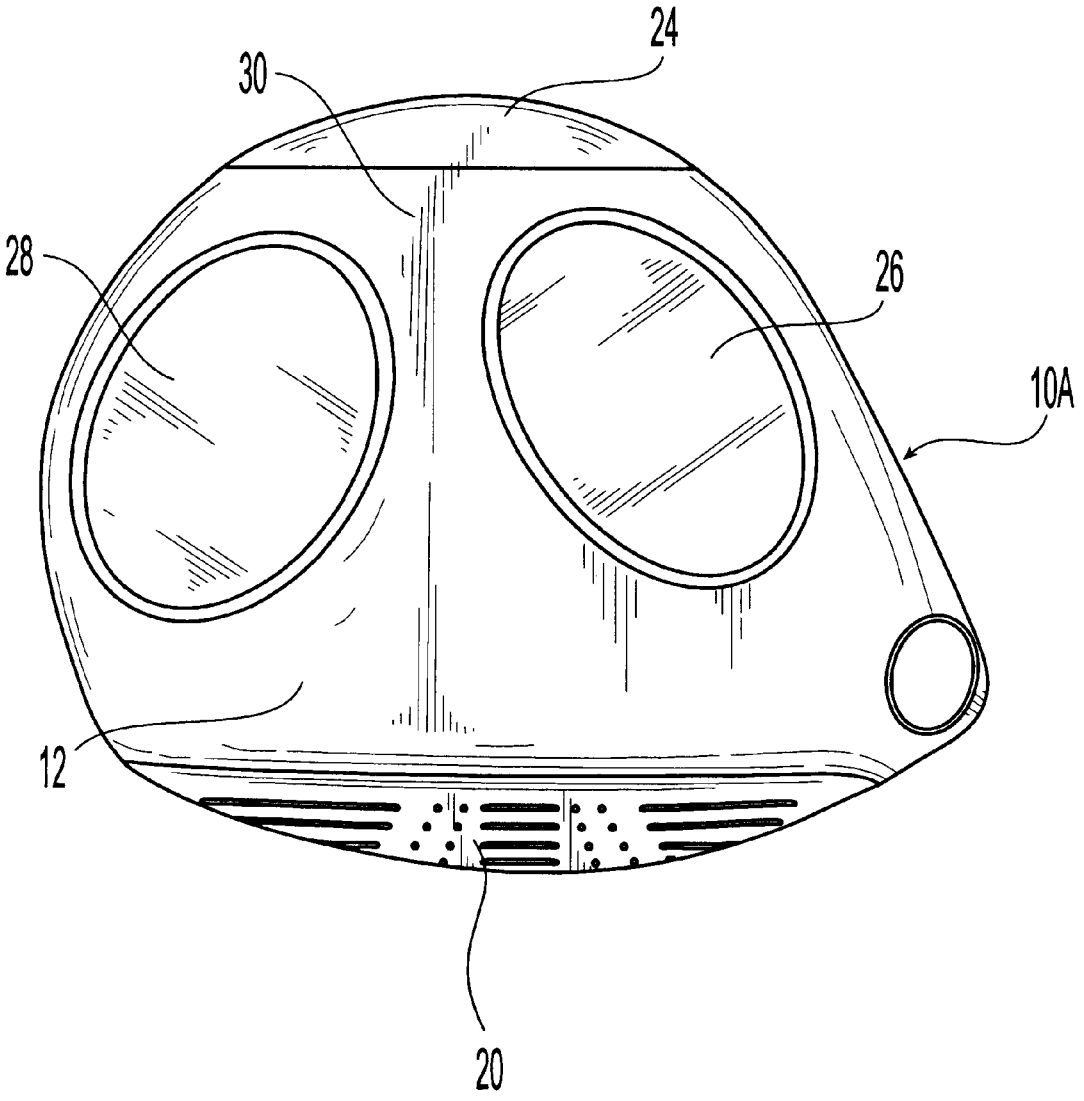
FIG. 6 is a top view of an alternative, hosel-less embodiment of the present invention.

The skilled artisan will readily recognize that other dimensions and other materials may be used for backweight 24 without departing from the scope of the present invention. Backweight 24 may be attached using two rivets 46 (FIG. 4) integral with backweight 24 that pass through back surface 22. The skilled artisan will recognize that backweight 24 may be attached using other means well known in the art without exceeding the scope of the present invention, such as using screws and/or a weld for example. In an example of a further alternative embodiment, FIG. 6 illustrates hosel-less club head 10A according to the present invention. Other than the hosel-less configuration, head 10A is otherwise the same as the exemplary embodiment described above.

Table 1 provides club head mass (M), volume (V) and moment of inertia about the center of mass ($I_{cm}$) for driver club heads sold on the market and two different club heads, Club Head No. 1 and Club Head No. 2, made in accordance with the present invention, with hosels as shown in FIGS. 1–5.

TABLE 1

| Club | M (g) | V ($cm^3$) | $I_{cm}$ ($g.cm^2$) |
|---|---|---|---|
| Club Head No. 1 (invention) | 197.6 | 240 | 3224 |
| Club Head No. 2 (invention) | 204.6 | 240 | 3332 |
| Callaway Great Big Bertha | 196.8 | 250 | 2898 |
| Taylor Made Ti Bubble II | 195.4 | 290 | 3200 |
| Titleist 975D | 204.8 | 260 | 3393 |
| Mizuno T-Zoid T-3 Mighty Big 9.5 | 198.2 | 290 | 3118 |
| Crane Magic Wand | 189.9 | 270 | 3230 |

Thus the combination of features as described above in connection with the present invention generally locates a greater percentage of the total club head mass behind the strike face, acting through the stiffened sole plate and crown to enhance the energy transfer and efficiency of the club in striking the ball. These enhancements are achieved according to the present invention without an increase in the club volume or mass, giving rise to improved club performance without the excessive volume characteristic of recent trends in metal woods, particularly drivers.

Although various embodiments of the present invention have been described, the descriptions are intended to be merely illustrative. Thus, it will be apparent to the skilled artisan that modifications may be made to the embodiments described herein without departing from the scope of the claims set forth below.

What is claimed is:

1. A metal wood club head, comprising:

a crown with a depending skirt and strike face, and a sole plate secured to the skirt and strike faces, said club head having a heel and a toe and a back portion on said skirt opposite the strike face;

at least one cavity defined in the sole plate to provide a contoured sole plate surface with increased stiffness; and a backweight attached to the skirt back portion, said backweight being included within an angle of not greater than about 110 degrees measured at the center of mass centered around a line perpendicular to the strike face.

2. The club head according to claim 1, wherein the sole plate defines:

a first cavity located rearwards and towards the heel of said club head; and a second cavity located rearwards towards the toe of said club head and approximately opposite of said first cavity to define a ridge therebetween extending back from the strike face.

3. The club head according to claim 2, wherein the crown defines two opposed dimples located rearwardly from the strike face separated by an hour-glass shaped spine.

4. The club head according to claim 2, wherein said first and second cavities include a bottom wall and a distinct side wall to form a web in the sole plate such that the sole plate stiffness is increased thereby.

5. The club head according to claim 2, wherein the volume of the club head is less than about 250 cc with a moment of inertia of at least about 3200 $g{\cdot}cm^2$.

6. The club head according to claim 5, having a mass of about 188 to 212 grams, wherein the backweight comprises about 7 to 15 percent of the total club mass.

7. The club head according to claim 6, wherein said head includes a hosel.

8. The club head according to claim 6, wherein said head is hosel-less.

9. The club head according to claim 2, wherein the sole plate further defines a dished recess positioned between and behind said first and second cavities such that said recess has a leading edge which defines a rearward boundary of the sole plate ridge.

10. The club head according to claim 9, wherein said rearward boundary is positioned at least about 0.1 inch behind the club head center of mass.

11. A metal wood club head, comprising:

a crown with a depending skirt and strike face, and a sole plate secured to the skirt and strike faces, said club head having a heel and a toe, and a back portion on said skirt opposite the strike face;

a first cavity defined by the sole plate located rearwards and towards the heel of said club head;

a second cavity defined by the sole plate located rearwards towards the toe of said club head and approximately opposite of said first cavity to define a ridge there between extending back from the strike face, wherein said first and second cavities include a bottom wall and a distinct side wall to form a web in the sole plate such that the sole plate stiffness is increased thereby;

a dish-shaped depression located rearward said first and second cavities and approximately in the center of said sole plate; and a backweight having a front face and attached to the skirt back portion, wherein said front face is tilted towards said heel.

12. The club head according to claim 11, wherein said backweight is behind and substantially in line with said ridge defined by the first and second cavities.

13. The club head according to claim 12 wherein the club head has a volume of less than about 250 cc and a moment of inertia of at least about 3200 $g{\cdot}cm^2$.

14. The club head according to claim 12 wherein the backweight is included within an angle of not greater than about 110 degrees measured at the center of mass centered around a line perpendicular to the strike face.

15. The club head according to claim 12 wherein the backweight is included within an angle of not greater than about 80 degrees measured at the center of mass centered around a line perpendicular to the strike face.

16. The club head according to claim 11, wherein said front face of said backweight is tilted towards said heel by an angle of about 3.5 to 6 degrees as measured from a line tangent to the face.

17. A metal wood club head, comprising:

a crown with a depending skirt and strike face, and a sole plate secured to the skirt and strike faces, said club head having a heel and a toe and a back portion on said skirt opposite the strike face, the club having a volume of less than about 250 cc and a moment of inertia of at least about 3200 $g{\cdot}cm^2$;

said crown defining two opposed dimples located rearwardly from the strike face separated by an hour-glass shaped spine;

a first cavity defined by the sole plate located rearwards and towards the heel of said club head;

a second cavity defined by the sole plate located rearwards towards the toe of said club head and approximately opposite of said first cavity to define a ridge therebetween extending back from the strike face, wherein said first and second cavities include a bottom wall and a distinct side wall to form a beam-like web in the sole plate the such that sole plate stiffness is increased thereby;

a dish-shaped depression located rearward said first and second cavities and approximately in the center of said sole plate; and a backweight attached to the skirt back portion, behind and substantially in line with said ridge defined by the first and second cavities, said backweight comprising about 7 to 15 percent of the club head mass and being included within an angle of not greater than about 110 degrees measured at the center of mass centered around a line perpendicular to the strike face.

* * * * *